US011185964B2

(12) United States Patent
Keeler

(10) Patent No.: US 11,185,964 B2
(45) Date of Patent: Nov. 30, 2021

(54) LENGTH EXTENSION ASSEMBLY FOR A HAND TOOL

(71) Applicant: John D. Keeler, Henderson, MD (US)

(72) Inventor: John D. Keeler, Henderson, MD (US)

(73) Assignee: John D. Keeler, Henderson, MD (US)

( * ) Notice: Subject to any disclaimer, the term of this patent is extended or adjusted under 35 U.S.C. 154(b) by 322 days.

(21) Appl. No.: 16/528,774

(22) Filed: Aug. 1, 2019

(65) Prior Publication Data

US 2021/0031339 A1 Feb. 4, 2021

(51) Int. Cl.
*B25B 23/00* (2006.01)
*B25B 13/06* (2006.01)
*B25B 13/46* (2006.01)

(52) U.S. Cl.
CPC ..... *B25B 23/0021* (2013.01); *B25B 23/0035* (2013.01); *B25B 13/06* (2013.01); *B25B 13/462* (2013.01)

(58) Field of Classification Search
CPC ..... B25B 23/0021; B25B 23/0035; B25B 13/462; B25B 13/06
See application file for complete search history.

(56) References Cited

U.S. PATENT DOCUMENTS 798,325 A 8/1905 Daddysman, Jr.
2,438,633 A * 3/1948 Condor ..... B25G 1/04 403/107
2,735,325 A 2/1956 Rudd, Sr.
2,963,930 A * 12/1960 Clothier ..... B25G 1/043 81/177.2
3,227,015 A 1/1966 Tremblay
4,367,663 A * 1/1983 Merics ..... B25B 13/481 403/377
5,927,161 A * 7/1999 Clifford ..... B25B 23/0021 81/177.2
6,523,441 B2 2/2003 Lee
6,971,290 B1 * 12/2005 Ybarra ..... B25B 23/0021 403/109.3
7,036,401 B2 5/2006 Carroll
7,188,553 B1 3/2007 Pryor
9,669,537 B2 * 6/2017 Hartman ..... B25G 1/043

* cited by examiner

*Primary Examiner* — David B. Thomas
(74) *Attorney, Agent, or Firm* — Faegre Drinker Biddle & Reath LLP

(57) ABSTRACT

A length extension assembly for a hand tool comprises at least two elongated extension tubings each having a longitudinal passageway and being of a size and shape that one of the tubings may be selectively inserted into the passageway of the other tubing. The assembly also includes at least two elongated extension bars each of a size and shape that each extension bar may be inserted into an appropriate tubing. The tubings are provided with longitudinally spaced locking holes. Each bar is provided with a locking member which can enter and be engaged in one of the locking holes to connect the bar to its tubing. Optionally, one tubing could be inserted into the larger tubing and a locking member on the smaller tubing could be engaged in a locking hole of the larger tubing to connect the tubings together. Various length selections can be achieved by connecting a bar to at least one tubing or by connecting a bar to one tubing and connecting that tubing to a larger tubing. Additional length adjustment is achieved by the engagement of a locking member in an appropriate locking hole.

19 Claims, 8 Drawing Sheets

LENGTH EXTENSION ASSEMBLY FOR A HAND TOOL

BACKGROUND OF INVENTION

There are often situations where it is desired or necessary to remove a screw or bolt in a tight place. This might require the use of a shorter tool or a longer tool or some extension attached to the tool. A mechanic or other user might find it necessary to have a large number of extensions in order to gain access to remote or difficult to reach locations required for various hand tools. These alternatives are questionable in their effectiveness and require the taking of storage space when not in use.

It would be desirable if a tool length extension could be provided having the capability of various desired lengths during use and of minimal storage space when not in use.

SUMMARY OF INVENTION

An object of this invention is to provide a length extension assembly that could be used for various hand tools.

Another object of this invention is to provide such an assembly which requires minimal storage space.

A further object of this invention is to provide such a length extension assembly which can easily be connected to a hand tool.

A yet further object of this invention is to provide a length extension assembly having the ability to achieve various length selections.

In accordance with this invention there are multiple extension tubings and corresponding multiple extension bars. These sets of tubings and bars include an elongated first extension tubing having a longitudinal passageway which is exposed at the tool connecting end of the tubing. A plurality of longitudinally spaced locking holes are in the peripheral wall of the tubing extending to the passageway. A locking member is provided in the passageway which is resiliently biased outwardly through one of the holes near the drive end of the tubing. An elongated first extension bar is included in the assembly. The drive end of the extension bar has a locking member resiliently biased outwardly. The first bar is of a size and shape to be inserted in the first tubing passageway so that the locking member may be engaged in one of the locking holes of the first tubing to connect the first tubing and first bar together. The tool end of the bar could be connected to a hand tool. The assembly includes a second elongated extension tubing also having a longitudinal passageway and a plurality of longitudinally spaced locking holes in its peripheral wall. The first tubing is of a size and shape that the first tubing can be inserted into the second tubing passageway and have the tubings connected together by the locking member of the first tubing extending through one of the holes in the second tubing. The assembly further includes a second elongated extension bar having a resiliently biased locking member at its drive end for engagement in one of the locking holes of the second tubing. The second extension bar is of a size and shape to be inserted into the second tubing. The provision of the two tubings and the two bars provides the user with the ability to achieve different combinations of tubings and bars and different lengths in accordance with the needs of the user.

In the preferred practice of this invention a third set of tubing and extension bar is also provided whereby each of the two smaller extension tubings has a resiliently biased locking member for selective engagement in a locking hole of a larger size tubing.

DETAILED DESCRIPTION

Figure 14:
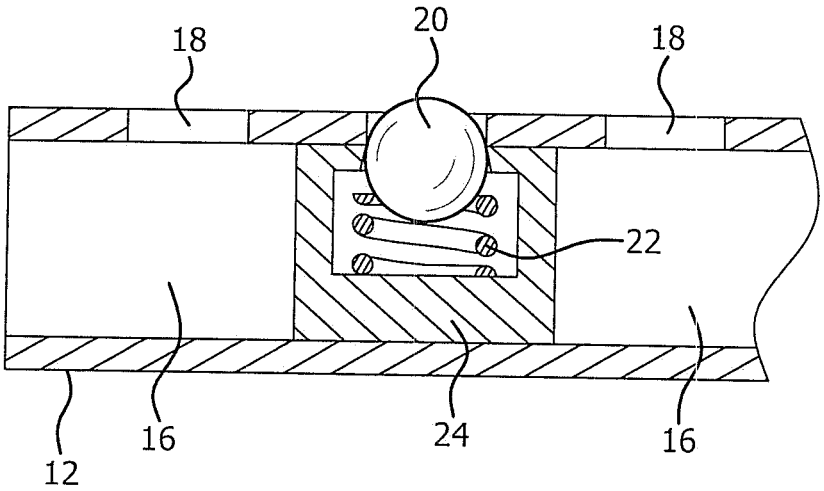
FIG. 14 is a cross-sectional view taken through FIG. 12 along the line 14-14.

The length extension assembly of this invention in general comprises sets of elongated extension tubings and corresponding elongated extension bars wherein there are at least two sets and preferably three sets, although there can be more than three sets. Figures A-3B illustrate three sets of tubings and bars. As shown therein a first or small extension tubing 10 has a peripheral wall and has a drive end 12 and a tool end 14. End 12 is referred to as a drive end because it would be closer to the end of the tubing where a handle or other drive structure would be attached. Similarly, end 14 is referred to as a tool end because it is closer to where the tool would be attached. Tubing 10 includes a longitudinal passageway 16 which is exposed at the drive end 12 and at the tool end 14. A plurality of longitudinally spaced aligned locking holes 18 is located in the peripheral wall of the tubing extending to the passageway 16. A locking member 20 is located in the passageway 16. As shown in FIG. 14 locking member 20 is resiliently mounted by providing a spring 22 in a seat 24 located in passageway 16. Locking member 20 has an inwardly slanted or curved outer surface which projects though the hole 18 of the tubing. In the preferred practice of this invention locking member 20 is a ball, such as a ball bearing. It is to be understood that other forms of locking members can be used such as a conical or a frusto-conical shape having an inwardly slanted surface projecting outwardly from the passageway.

Figure 1B:
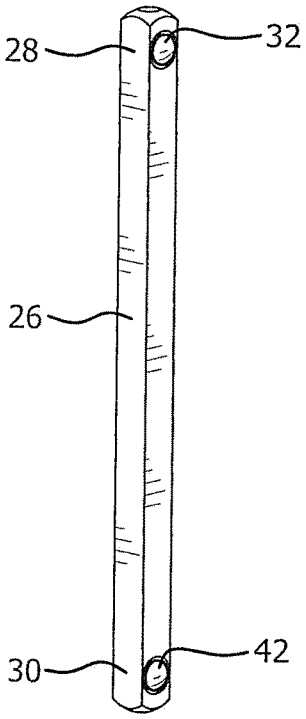
FIG. 1B is a perspective view of a small size elongated extension bar in accordance with this invention.
Figure 13:
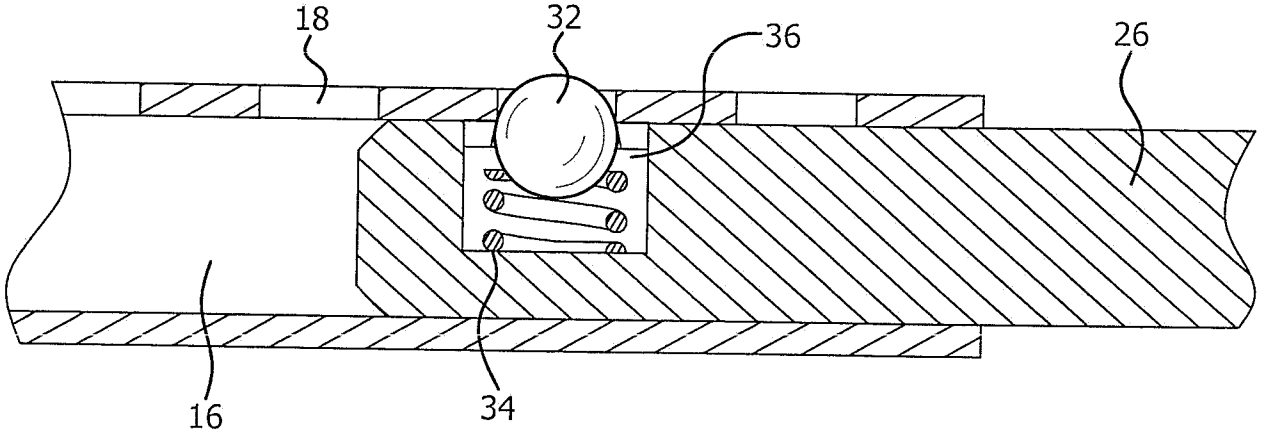
FIG. 13 is a cross-sectional view taken through FIG. 12 along the line 13-13.

The small or first extension bar 26 shown in FIG. 1B is associated with tubing 10. Bar 26 has a peripheral surface with a drive end 28 and a tool end 30. A locking member 32 is located at the drive end 28 of bar 26. As shown in FIG. 13 locking member 32 is resiliently biased outwardly by a spring 34 in a recess 36 of bar 26. Thus, locking member 32 projects outwardly through a corresponding hole 18 in the tubing. As illustrated, locking member 32 can be structurally the same as locking member 20. Bar 26 is of a size and shape that it can be inserted into the tubing passageway 16 to a desired position so that the locking member 32 will enter and be engaged with a selected locking hole 18 to connect the tubing 10 and the bar 26 together. As shown in FIGS. 7-11 when in the connected position the bar 26 extends out of tubing 10. As shown in FIGS. 7-11 the tool end of bar 26 could thereby be connected to a hand tool at the portion of the bar 26 extending out of tubing 10.

Figure 1A:
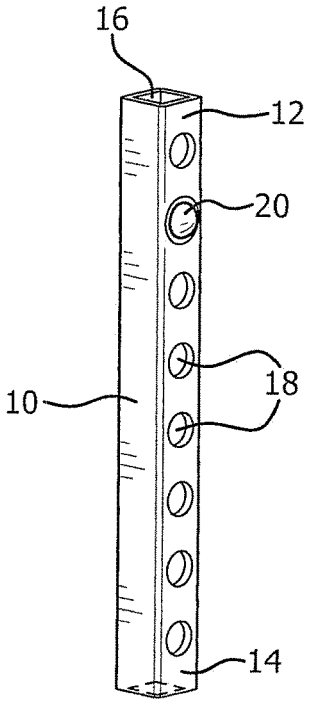
FIG. 1A is a perspective view of a small size elongated extension tubing in accordance with this invention.
Figure 2A:
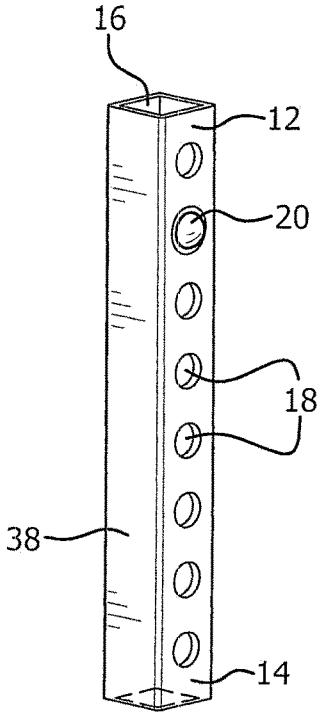
FIG. 2A is a perspective view of an intermediate size extension tubing in accordance with this invention.
Figure 2B:
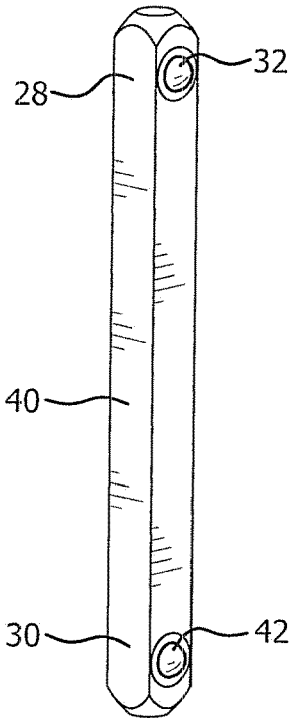
FIG. 2B is a perspective view of an intermediate size extension bar in accordance with this invention.

FIG. 2A shows an intermediate size or second elongated extension tubing 38 which, except for its size, is the same as smaller tubing 10. Thus, tubing 38 includes a drive end 12, a tool end 14, a longitudinal passageway 16, locking holes 18 and a locking member 20. FIG. 2B similarly illustrates an intermediate size or second elongated extension bar 40 which, except for size, is the same as small extension bar 26. Each extension bar 26,40 also includes a further resiliently biased locking member 42 at its tool end 30 to facilitate the attachment of the locking bar with a tool as later described. Tool end locking member 42 would be structurally the same as drive end locking member 32.

Figure 8:
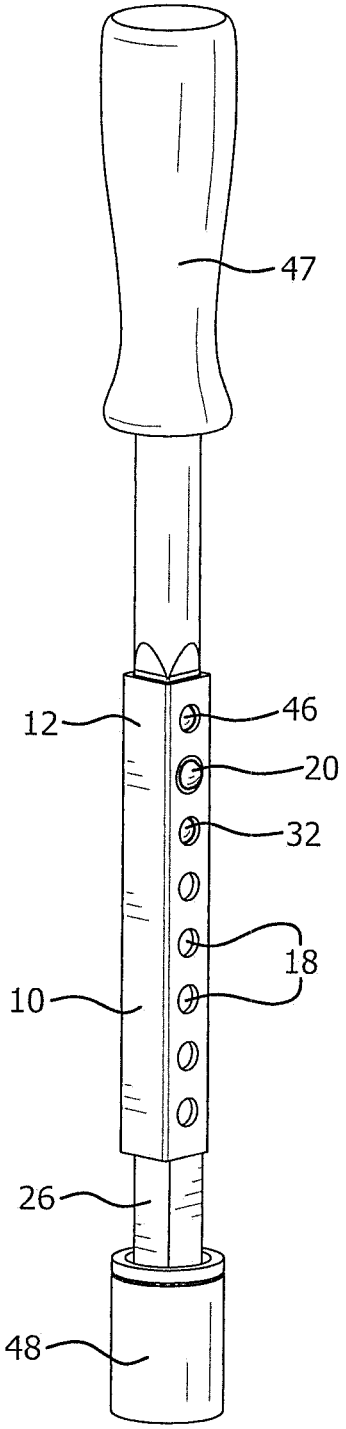
FIGS. 8-9 are perspective views of different size extensions of the components shown in FIG. 7.
Figure 9:
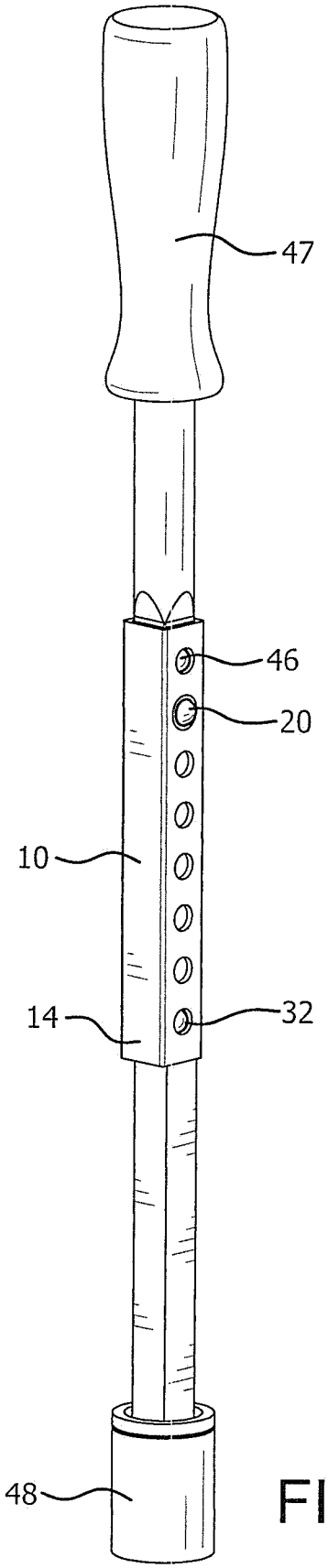

The provision of two sets of tubings 10,38 and two sets of bars 26,40 provides the user with the ability to select different length extensions. In that regard, if a small length extension is only necessary bar 26 could be inserted into tubing 10 and the specific length extension would be determined by the specific hole 18 for locking member 32. FIGS. 8-9 show different hole selections. The drive end 12 of tubing 10 could be attached to a drive member or tubing 10 itself could be used as a handle. The tool end 30 of bar 26 could be attached to a tool as later described. Alternatively, depending on the dimensions of, for example, the tool itself, tubing 38 and bar 40 might be used for a smaller length extension. If a longer extension is desired tubing 10 (which is of a size and shape to fit in passageway 16 of tubing 38) can be inserted into the passageway 16 of tubing 38. Bar 26 would be inserted into tubing 10 as previously described.

During the insertion or removal of a bar from a tubing or of a smaller tubing from a larger tubing, the locking member may enter an unintended hole. The insertion or removal can be continued by pressing the locking member inwardly to disengage the locking member from that hole.

Figure 3A:
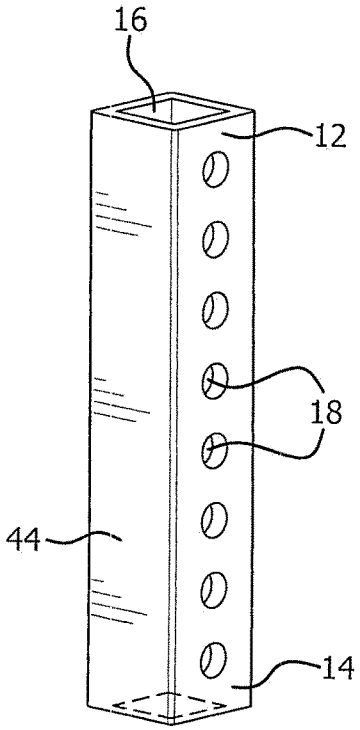
FIG. 3A is a perspective view of a large size extension tubing in accordance with this invention.
Figure 3B:
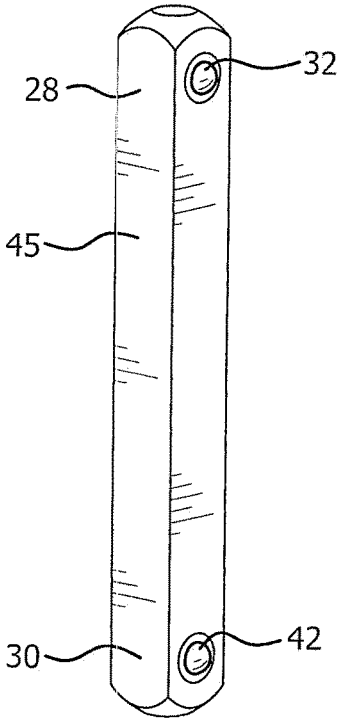
FIG. 3B is a perspective view of a large size extension bar in accordance with this invention.

FIG. 3A illustrates a large size or third elongated extension tubing 44 and FIG. 3B illustrates its associated bar 45. The tubing 44 could be identical to tubings 10 and 38 except for size and except that, because it is the largest size tubing, it does not require a locking member such as locking member 20 to connect tubing 44 to any other tubing. Bar 45, except for size, is identical to bars 26 and 40. As previously noted the invention could be practiced where the outermost tubing itself is used as a handle rather than requiring a separate drive structure to be mounted to the outermost tubing. In such case, particularly for large tubing 44, the outer surface of the peripheral wall of tubing 44 could have a smooth or ergonomical shape.

Figure 4:
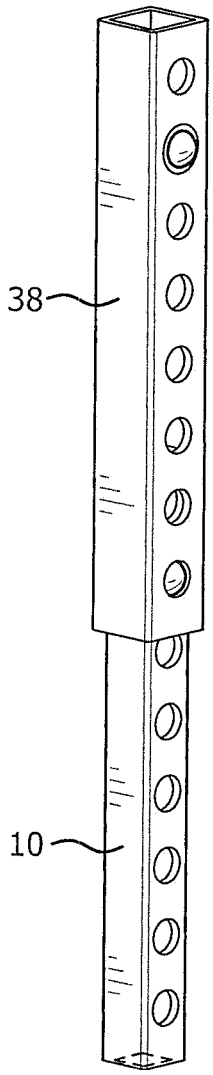
FIGS. 4-6 are perspective views showing various combinations of extension tubings connected together in accordance with this invention.
Figure 5:
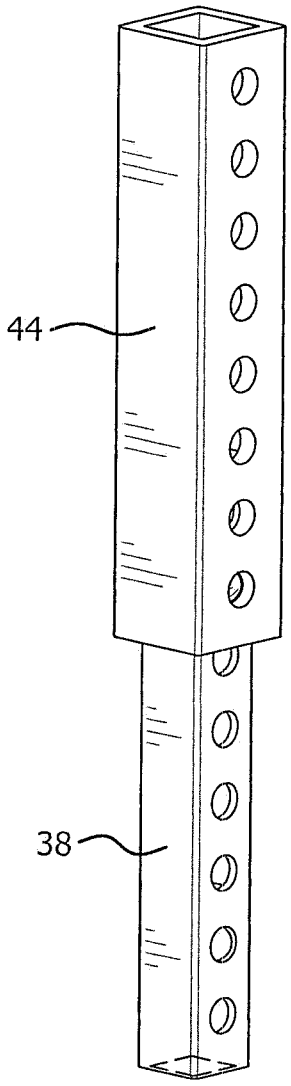
Figure 6:
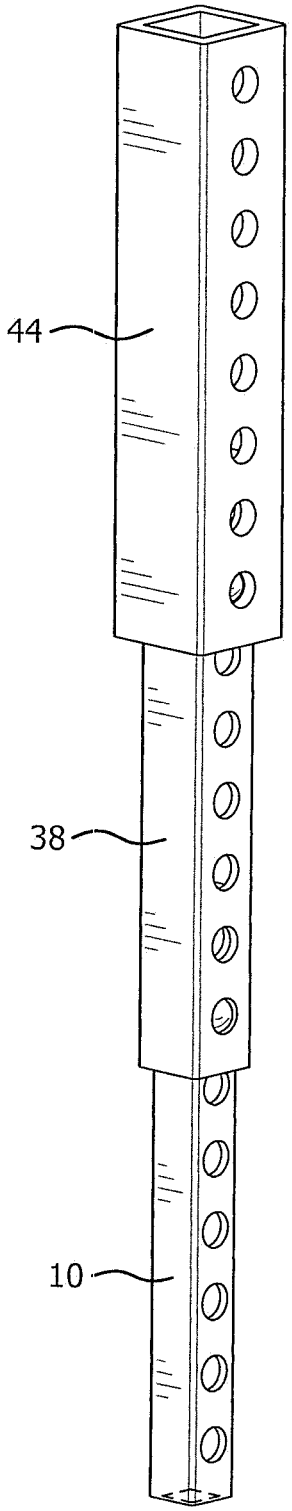

The length extension assembly of this invention provides the user with a large selection of desired extension lengths by the use of various combinations of tubings and bars. For example, as previously described, if a short extension is desired tubing 10 and bar 26 could be used where appropriate for the tool connection size. Thus, if the tool connection requires a size of ¼th inch and tubing 10 and bar 26 are appropriately dimensioned, that combination of tubing and bar would be used. If the tool connection requires a size of ⅜th inches, second tubing 38 and bar 40 could be used. If a larger size such as ½ inch is required, tubing 44 and bar 45 can be used. The invention could, of course, be practiced with other dimensions. The specific length achieved by the single set of tubing and bar would also be determined by the hole 18 engaged by locking member 32. Where a shorter length is desired locking member 32 would be inserted in a hole 18 closer to tool end 14, as shown in FIG. 8. Where a longer extension is desired locking member 32 would be inserted in a hole closer to drive end 12, as shown in FIG. 9. FIGS. 4-6 show other combinations where more than one tubing is used to achieve a greater length. FIG. 4 illustrates tubing 10 to be inserted into tubing 38. In such case, bar 26 would also be inserted into tubing 10 and attached to a tool. If a larger size diameter is required, tubing 38 could be inserted into tubing 44, as shown in FIG. 5 and bar 40 would be inserted into tubing 38. The largest size extension is illustrated in FIG. 6 where tubing 10 is inserted into tubing 38 and tubing 38 is inserted into tubing 44, bar 26 would be inserted into tubing 10.

Figure 7:
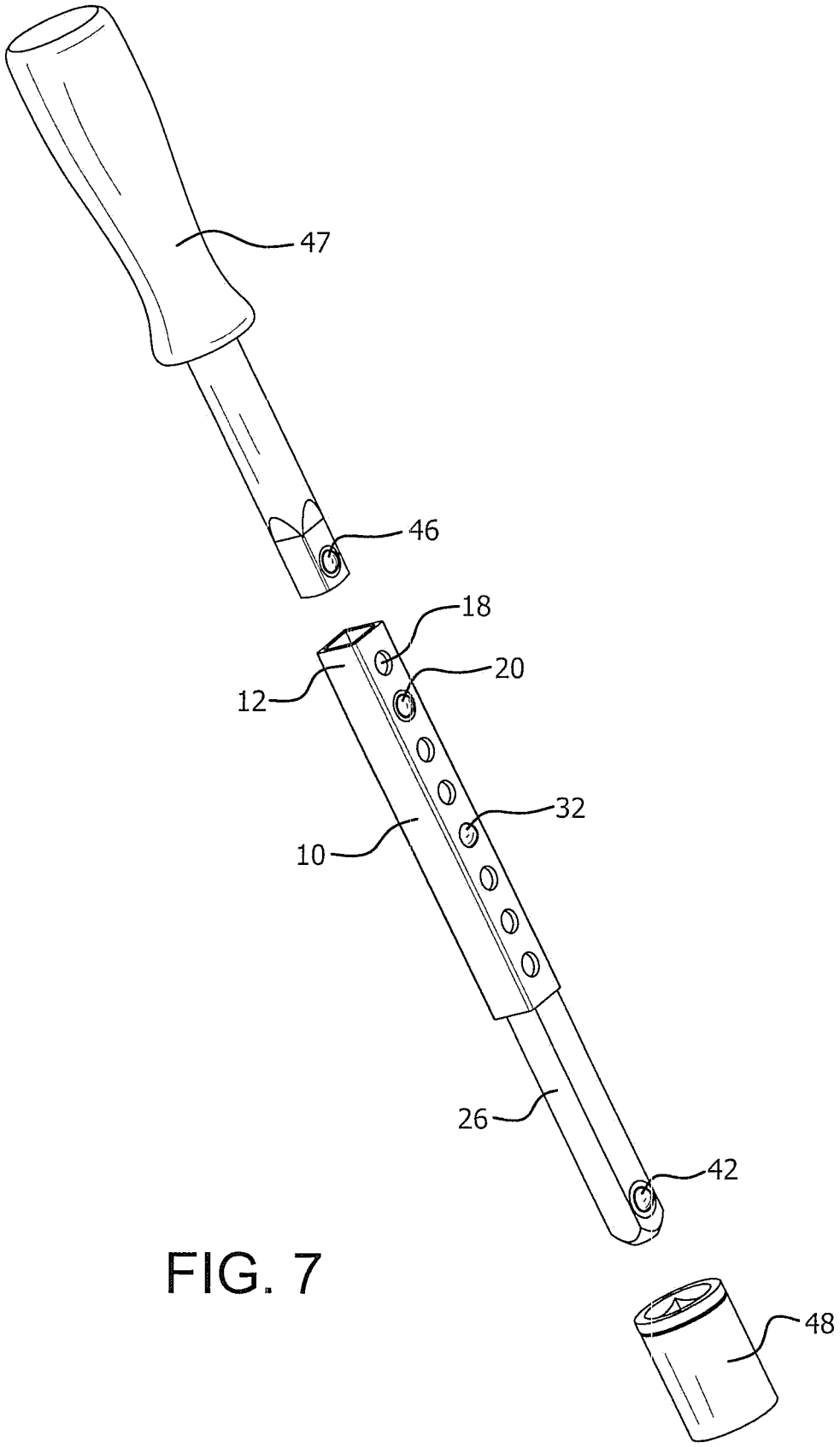
FIG. 7 is an exploded view showing one combination of extension tubing and extension bar to be assembled to a hand tool and to a handle.

FIG. 7 illustrates in an exploded view the attachment of a selected tubing extension to a tool and to a drive structure. As illustrated a handle 47 is to be connected to tubing 10. Any suitable manner of connection may be used. In the form illustrated in FIG. 7 handle 47 includes a resiliently biased locking member 46 which would be engaged in the hole 18 closest to the drive end 16. Locking member 46 could be resiliently biased in the same manner as locking members 20, 32 and 42. Bar 26 would be connected to a tool socket 48 in any suitable manner such as by its locking member 42 being engaged in a hole in socket 48. FIG. 8 shows the length extension tubing 10 and bar 26 connected to handle 44 and socket 48. In this illustration the locking member 32 is mounted in a hole 18 near the tool end 12. As noted if a longer length is desired, such as shown in FIG. 9, the locking member 32 would extend through a hole 18 closer to the tool end 14.

Figure 10:
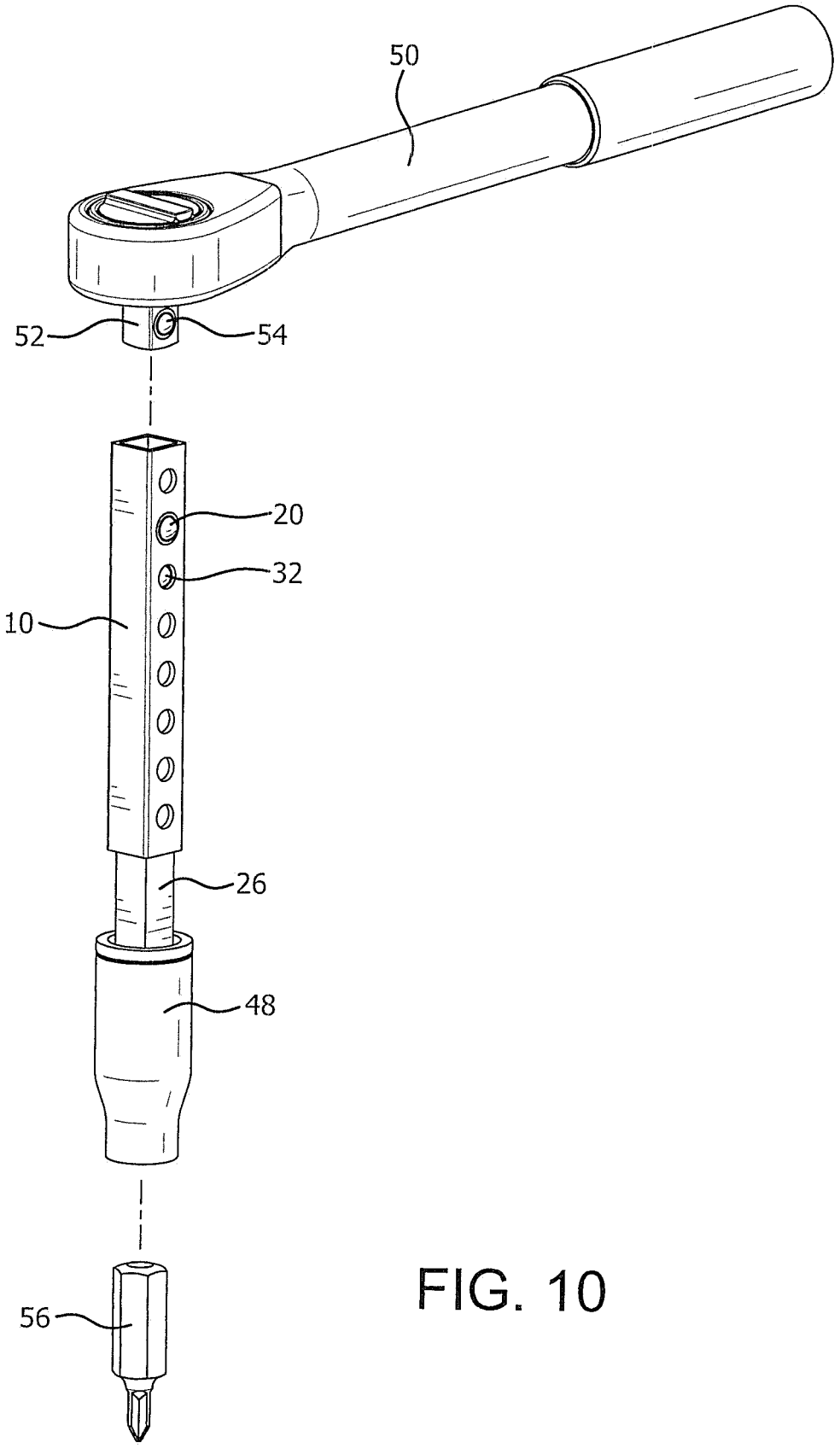
FIG. 10 is an exploded view similar to FIG. 7 showing a ratchet to be connected to the extension assembly.
Figure 11:
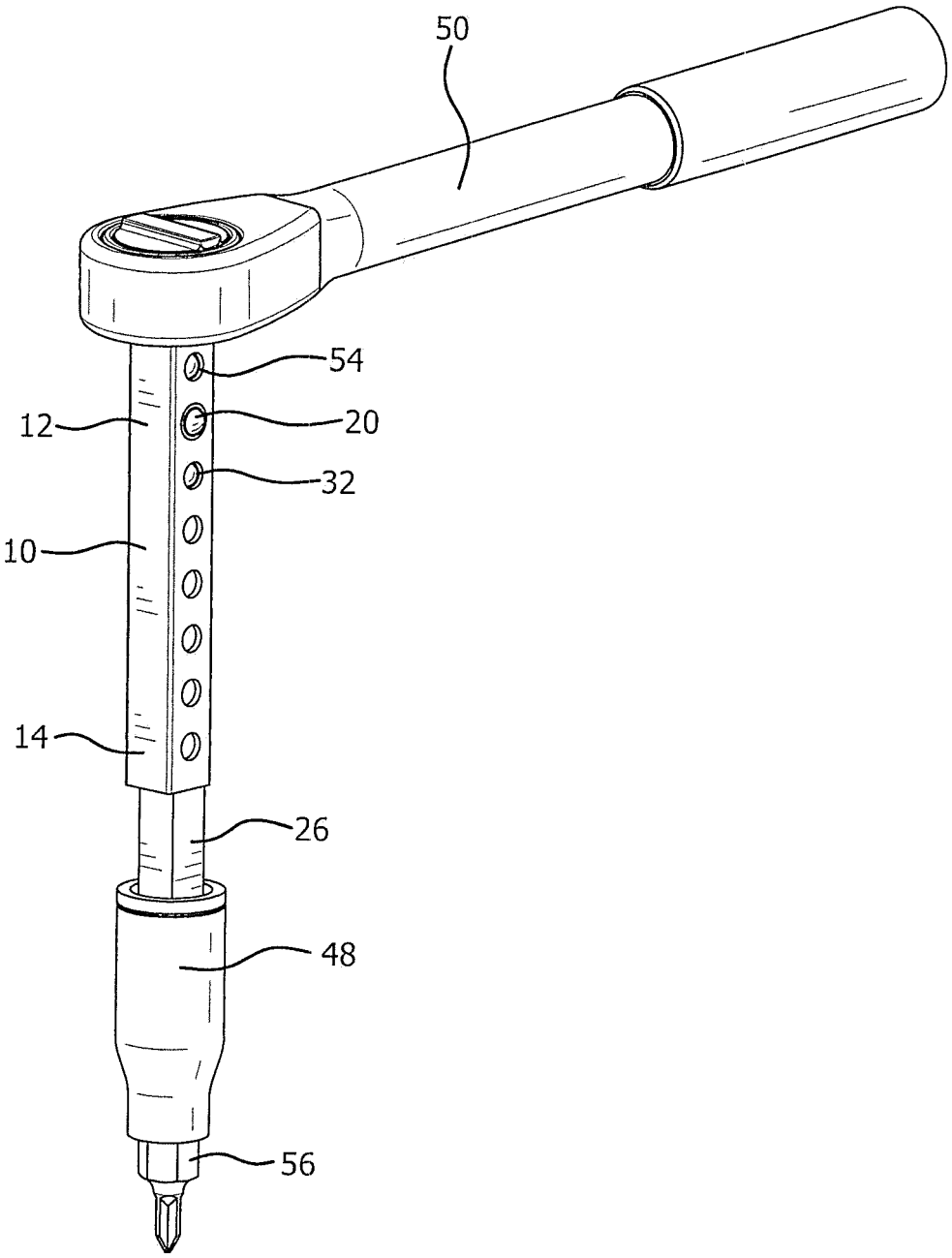
FIG. 11 is a perspective view showing the components of FIG. 10 connected together.
Figure 12:
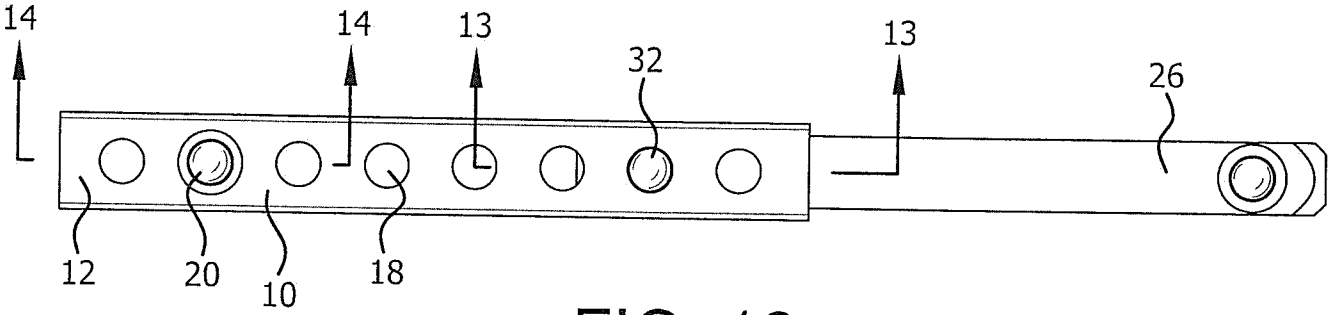
FIG. 12 is a top plan view showing an extension bar inserted into an extension tubing.

While FIGS. 7-9 illustrate a handle 47 as the drive structure, other drive structures can be used. FIGS. 10-11, for example, show a ratchet 50 as the drive structure. Ratchet 50 could be of known structure and attached to the extension tubing in any suitable manner. As illustrated, ratchet 50 includes a shank 52 with a locking member 54 which could be similar to the locking members on the tubings and bars. FIGS. 10-11 also show additional details of the tool itself. As illustrated, a tool bit 56, such as a screwdriver bit, could be mounted into socket 48. Screwdriver bits 56 are available in various types with, for example, a standard ¼ inch base in a hexagon shape. The passageway 16 and the various bars preferably have a square shape to fit into the upper portion of socket 48, while a hexagon shaped hole at the bottom of socket 48 receives tool bit 56. Various tool bits could include a straight blade or a standard head, a phillips head, a hexagonal head or a square head, as well as others. It is to be understood that various tools may be used, not limited to removal or insertion of screws or bolts.

FIG. 11 illustrates the components of FIG. 10 in their assembled condition. As shown, locking member 54 of ratchet 50 is engaged in the uppermost hole 18 at the drive end 12 of tubing 10. In this illustration where only a shorter extension length is needed locking member 32 is engaged in a hole near the drive end 12 so that only a shorter portion of bar 26 extends from tubing 10. It should be noted that a characteristic of the various tubings is that the last or uppermost hole nearest to the drive end is always open so as to be available to receive a locking member of a drive structure. In tubings 10 and 38 the locking member 20 is located at the second or penultimate hole from the drive end.

As is apparent the length adjustment assembly of this invention provides a wide variety of different lengths which can be obtained by the various combination of tubings and bars and by the location of a bar in a tubing or a tubing in a tubing. In addition, because the assembly components are removable from each other the assembly is collapsible, thus requiring less storage space. By proper size selection the assembly could be used with available tools and drive structures.

It should be understood that while the above description is for the preferred embodiment of this invention, the invention could be practiced in other manners without departing from the spirit of this invention. For example, in the preferred practice of this invention the passageways, the tubings and the bars have a square shape. This assures alignment of a locking member with a locking hole. Other shapes, however, may be used including a non-circular shape, a circular shape, a rectangle, an oval or a trapezoid. Irregularly shaped passageways and similarly shaped bars may also be used. Where a square shape is used there might be sufficient clearance between the bar and its tubing passageway or between one tubing and another tubing to permit a slight rotation or turning so that a locking member is not precisely aligned with the locking holes during insertion and then when the proper distance is reached the locking member can be shifted back to engage a locking hole. This would be particularly suitable if the tubings are made of a transparent material, such as a hard plastic, so that the user could see when the appropriate distance is reached for engaging a locking member in a locking hole. The reverse procedure would be used for removal. Another variation which permits the bar (or a smaller tubing) to be inserted in a tubing with the locking member not precisely aligned with the tubing locking holes would be to have an index mark at the outer edge of the bar in line with its locking member and a corresponding index mark could be on the outer edge of the tubing in line with the locking holes. The bar (or smaller tubing) could be inserted with the marks out of alignment so that during insertion the locking member does not move into and out of the holes while positioning the locking member for the desired length. Then, when the desired length is achieved the bar could be rotated until the marks are aligned. Only a slight back/forth adjustment would have the locking member enter the desired hole.

In the preferred practice of this invention a bar is connected to the tool and a tubing is connected to the drive structure by use of resiliently biased locking members. Other forms of connection may also be used, such as a threaded engagement, a bayonet lock, a nut/bolt or a clamp. A further variation is the use of a bridge member that could be attached at one end to the tool in any manner that does not require modification of the tool and the bridge member could be attached at its other end to the bar. A bridge member could also be used to attach the outermost tubing to a drive structure.

The invention claimed is:

1. A length extension assembly for a hand tool comprising (a) an elongated first extension tubing having a peripheral wall and having a drive end and a tool end, a longitudinal passageway in said first tubing exposed at said tool end, a plurality of longitudinally spaced locking holes in said peripheral wall extending to said longitudinal passageway, a locking member in said passageway resiliently biased outwardly through one of said holes near said drive end, (b) an elongated first extension bar having a peripheral surface and a drive end and a tool end, a drive end locking member resiliently biased outwardly, said first bar being of a size and shape to be inserted in said first tubing passageway and for said drive end locking member to enter and be engaged in one of said first tubing locking holes to selectively connect said first tubing and said first bar together with said first bar extending out of said first tubing, said tool end being adapted to be connected to a hand tool at a portion of said first bar extending out of said first tubing, (c) an elongated second extension tubing having a peripheral wall and having a drive end and a tool end, a longitudinal passageway in said second tubing exposed at said tool end, a plurality of longitudinally spaced locking holes in said peripheral wall extending to said longitudinal passageway, said passageway being of a size and shape to permit said first tubing to be inserted into said second tubing passageway and for said drive end locking member of said first tubing to enter and be engaged in one of said second tubing locking holes to selectively connect said first tubing and said second tubing with said first tubing extending out of said second tubing, and (d) an elongated second extension bar having a peripheral surface and a drive end and a tool end, a drive end locking member resiliently biased outwardly, said second bar being of a size and shape to be inserted into said second tubing passageway and for said second bar drive end locking member to enter and be engaged with one of said second tubing locking holes to selectively connect said second tubing and said second bar with said second bar extending out of said second tubing, said tool end of said second bar being adapted to be connected to a hand tool at a portion of said second bar extending out of said second tubing, whereby a combination of said tubings and said bars which includes only one of said bars and at least one of said tubings provides a plurality of different length extensions for the hand tool.

2. The assembly of claim 1 wherein said locking holes in each of said first tubing and said second tubing are longitudinally aligned, and said locking member in each of said first tubing and said first bar and said second bar has an inwardly tapered surface.

3. The assembly of claim 2 wherein each of said locking members is of ball shape.

4. The assembly of claim 2 wherein said tool end of each of said first bar and said second bar includes a locking member adapted to be connected to a tool.

5. The assembly of claim 4 wherein on each of said first bar and said second bar said tool end locking member and said drive end locking member aligned with each other.

6. The assembly of claim 4 wherein said drive end locking member on each of said first bar and said second bar is aligned with said locking holes in a respective first tubing and second tubing when said first bar or said second bar is inserted into its respective tubing.

7. The assembly of claim 4 wherein said second tubing has a locking member in said second tubing passageway resiliently biased outwardly through one of said second tubing holes near said second tubing drive end, and including (e) an elongated third extension tubing having a peripheral wall and having a drive end and a tool end, a longitudinal passageway in said third tubing exposed at said tool end, a plurality of longitudinally spaced locking holes in said peripheral wall extending to said longitudinal passageway, said longitudinal passageway being of a size and shape to permit said second tubing to be inserted into said third tubing passageway and for said drive end locking member of said second tubing to enter and be engaged in one of said third tubing locking holes to selectively connect said second tubing with said third tubing with said second tubing extending out of said third tubing, and (f) an elongated third extension bar having a peripheral surface and a drive end and a tool end, a drive end locking member resiliently biased outwardly, said third bar being of a size and shape to be inserted into said third tubing passageway and for said third bar locking member to enter and be engaged with one of said third tubing locking holes to selectively connect said third tubing and said third bar with said third bar extending out of said third tubing, and said tool end of said third bar being adapted to be connected to a hand tool at a portion of said third bar extending out of said third tubing.

8. The assembly of claim 7 wherein said locking member on said first tubing and said locking member on said second tubing is inserted into a penultimate hole at said drive end of each of said first tubing and said second tubing, and said third tubing having no locking member.

9. The assembly of claim 8 wherein said passageways in each of said first tubing and said second tubing and said third tubing are of square shape, each of said first bar and said second bar and said third bar being of square shape, and each of said first tubing and said second tubing and said third tubing being of square shape.

10. The assembly of claim 7, in combination thereof, one of said first tubing and said second tubing and said third tubing and one of said first bar and said second bar and said third bar being connected together with said connected bar extending out of its connected tubing, and a tool being connected to said extended bar.

11. The assembly of claim 10 wherein two of said tubings and one of said bars are connected together.

12. The assembly of claim 11 wherein three of said tubings and first said bar are connected together.

13. The assembly of claim 12 wherein a handle is connected to said third tubing.

14. The assembly of claim 12 wherein a ratchet is connected at the drive end of said third tubing.

15. The assembly of claim 11 wherein a handle is connected at the drive end of the outermost tubing.

16. The assembly of claim 11 wherein a ratchet is connected at the drive end of the outermost tubing.

17. The assembly of claim 10 wherein a handle is connected to said connected tubing.

18. The assembly of claim 17 wherein said handle is connected to said connected tubing by connecting structure engaged with a locking hole at said drive end of said connected tubing.

19. The assembly of claim 10 wherein a ratchet is connected to said connected tubing.

* * * * *